US006475246B1

(12) United States Patent
Pariser et al.

(10) Patent No.: US 6,475,246 B1
(45) Date of Patent: Nov. 5, 2002

(54) DRY CLEANING ADDITIVE, BATH, AND METHOD

(75) Inventors: Albert A. Pariser, Clifton, NJ (US); Joel Speer, Secaucus, NJ (US)

(73) Assignee: Pariser Industries

( * ) Notice: Subject to any disclaimer, the term of this patent is extended or adjusted under 35 U.S.C. 154(b) by 0 days.

(21) Appl. No.: 09/575,571

(22) Filed: May 22, 2000

(51) Int. Cl.[7] ..... C11D 3/10

(52) U.S. Cl. ..... 8/142; 8/137; 510/277; 510/278; 510/286; 510/299; 134/42

(58) Field of Search ..... 8/142, 137; 134/42; 510/277, 278, 286, 299

(56) References Cited

U.S. PATENT DOCUMENTS

| | | | | |
|---|---|---|---|---|
| 3,539,521 | A | | 11/1970 | Snoddy |
| 3,619,115 | A | | 11/1971 | Diehl |
| 3,929,680 | A | | 12/1975 | Arai et al. |
| 4,005,029 | A | | 1/1977 | Jones |
| 4,006,092 | A | | 2/1977 | Jones |
| 4,013,575 | A | * | 3/1977 | Castrantas et al. |
| 4,051,046 | A | | 9/1977 | Diehl et al. |
| 4,176,080 | A | | 11/1979 | Wise et al. |
| 4,180,472 | A | | 12/1979 | Mitchell et al. |
| 4,199,483 | A | | 4/1980 | Jones |
| 4,238,346 | A | | 12/1980 | Sugahara et al. |
| 4,267,077 | A | | 5/1981 | Niimi |
| 4,902,434 | A | | 2/1990 | Dickerson |
| 5,306,444 | A | | 4/1994 | Kitamura et al. |
| 5,632,780 | A | * | 5/1997 | Siklosi |

FOREIGN PATENT DOCUMENTS

| | | | |
|---|---|---|---|
| JP | 363275697 A | * | 11/1988 |

* cited by examiner

*Primary Examiner*—Gregory E. Webb
(74) *Attorney, Agent, or Firm*—Bierman, Muserlian and Lucas

(57) ABSTRACT

An additive for introduction into a dry cleaning solvent, and a method of use thereof, which reduces static electricity, minimizes linting, fights acidity to reduce corrosion, deodorizes the solvent, and does not adversely affect the filtering operation. The additive contains sodium bicarbonate and an anti-static agent; preferably in the presence of an odorant.

7 Claims, No Drawings

DRY CLEANING ADDITIVE, BATH, AND METHOD

The present Invention is directed to an improvement in dry cleaning, more specifically a method and pretreatment additive which are capable of both deodorizing and improving the elimination of stains and contaminants from fabric.

BACKGROUND OF THE INVENTION

Existing dry cleaning systems utilize perchlorethylene or hydrocarbon solvents with elevated flash points. Into these systems various contaminants are introduced. One source of contaminants is body excrements (i.e. perspiration and body oil, generally known as sebaceous soil), primarily comprised of short-chain fatty acids. These fatty acids can contribute to system acidity, odors, and garment staining (swales).

Another contaminant found in the dry cleaning system is moisture. One of the most important ways in which moisture enters the system is as a result of pre-spotting. When there are water soluble stains to be removed, it is customary for operators to use live steam in advance of the dry cleaning process.

Moisture also enters the system from that which is inherently in the fabric (also known as fiber regain), as well as a broad range of pre-spotting detergents and system detergents. All of these may contain water introduced during manufacture.

Fabric stains fall into two principal categories, water soluble stains (usually called "sweet" stains) and oil soluble stains. The solvent is effective to remove the latter, but not the former. Therefore, the presence of water in the system, if properly utilized, assists in the removal of the sweet stains.

However, the presence of water in the system presents certain problems and, for best results, it is important that a proper balance be maintained. If there is an excess of water, shrinkage, redeposition and the like occur because the known detergents do not hold the water in a complete suspension. In addition, the dry cleaning machines themselves contain elements which will be corroded in the presence of water, especially if the system is acidic. Moreover, it has been found that such corrosion can occur quite rapidly. On the other hand, since the presence of water aids in removing the water soluble stains which the dry cleaning solvent would otherwise leave behind, the aforementioned balance is necessary if the systems are to function at maximum efficiency.

In addition to the foregoing, stabilizers are customarily introduced (especially if perchlorethylene is the solvent) in order to minimize the corrosive effect on the metal surfaces and elements within the dry cleaning machine, as well as any metallic buttons or other ornamentation found on the fabric itself. Most dry cleaning machines are equipped with distillation units which are used throughout the day to constantly purify the solvent. However, this process destroys the original stabilizer, thereby permitting the distilled solvent to become increasingly acidic. When this occurs, the corrosive attack on any metal contacted by the solvent is increased, and malodors are created and become increasingly pervasive throughout the entire system. Thus, washing systems (whether dry or wet) perform best on the alkaline side, e.g. at a pH of at least 7, preferably 7 to 9 ½, most preferably 8.3 to 8.5.

Furthermore, distillation creates yet another problem. It removes coloration, fatty acids, residues, etc.; however, it also removes detergents, whereby the separation of water and the solvent can readily occur. Since the solvents themselves become corrosive when combined with the water at an acid pH, redeposition can occur and undesirable odors can be generated.

In addition to the foregoing, water in the dry cleaning system, if properly dispersed, acts to conduct static electricity to ground. The static is generated by friction occurring within the dry cleaning machine and, if the water is not properly dispersed, an electrical imbalance occurs and the ability to ground the static charge is impaired. The result of the static electricity is linting and poor "drape" of the garments being cleaned.

SUMMARY OF THE INVENTION

In order to achieve the proper water-solvent balance, the present Invention provides a pretreatment additive which is introduced into the solvent upstream of the cleaning bath. The additive reduces static electricity which can cause linting, neutralizes solvent acidity to reduce corrosion, odorizes the solvent, and does not adversely affect the filtering and distillation operations. In accordance with the present Invention, the additive contains sodium bicarbonate and an antistatic agent; preferably, an odorant is also included.

DETAILED DESCRIPTION OF THE INVENTION

The additive of the present Invention advantageously includes at least 90% by weight of sodium bicarbonate and at least 1% by weight of the antistatic agent. For best results, an odorant is present and it preferably consists of at least 1% by weight based on the additive.

The present Invention is used by introducing approximately 3 to 5 ounces of the additive ahead of the dry cleaning bath of a 50 pound capacity machine. The additive is circulated with the solvent throughout the machine system, inclusive of its filters, 4–5 minutes, whereby it reacts with the solvent in the reservoir to provide the aforementioned benefits. The actual dosage may vary depending upon system water content; generally, the above dosage will permit subsequent processing of up to 400 pounds of garments.

EXAMPLE

The additive consists of, by weight, 98% sodium bicarbonate, 1% Larostat (an anti-static agent manufactured by BASF), and 1% methyl salicylate. 4 ounces of the additive per 400 pounds dry weight of fabric is introduced into a standard dry cleaning machine and circulated for 4 ½ minutes prior to dry cleaning. Subsequently, the fabric, solvent, and additive are agitated for the usual period of time after which the fabric and solvent are separated.

Since the odor-causing contaminants, which include short-chain fatty acids (known as sebaceous soil), are to be found to varying degrees in both the water and the solvent components of the dry cleaning system, it is desirable that the additive be partially soluble in both the water and solvent phases.

Existing dry cleaning machines customarily include distillation devices so that the solvent can be purified and reused. The mixture of water and solvent is passed through a carbon, paper, and/or other type of filter, thereby leaving some of the additive on the filter. This not only allows at least some of the first dose of additive to remain in the bath, but also provides a porous upstream surface on the filter.

The filter is usually rotary and a doctor blade is provided to bear against the upstream surface of the filter and keep it clean. The amount of water present should be controlled so that the filter does not become saturated with water so that it can no longer perform its function. The residual additive accumulated on the filter surface aids in preventing this from happening. After the filtration step, all or a portion of the mixture is distilled. Since an azeotrope is formed, at least some of the additive is carried over into the distillate, thus permitting the original single dose to continue to be effective through a plurality of loads. The present Invention is fully compatible with all of the foregoing, assists in preventing saturation of the, filter with water, and constitutes a substantial improvement on existing systems and methods.

Although only a limited number of embodiments of the present Invention have been expressly disclosed it is, nonetheless, to be broadly construed and not to be limited except by the character of the claims appended hereto.

We claim:

1. An additive for a dry cleaning solvent consisting essentially of at least 90% by weight of a sodium bicarbonate, at least 1% by weight of an antistatic agent and at least 1% by weight of an odorant.

2. The additive of claim 1 comprising at least 98% by weight of said sodium bicarbonate.

3. The additive of claim 1 comprising 98% by weight of said sodium bicarbonate.

4. The additive of claim 3 wherein said odorant is sodium salicylate or methyl salicylate.

5. A method of dry cleaning fabric comprising introducing the additive of claim 1 into a dry cleaning solvent, in an amount of at least 3 ounces per 400 pounds of said fabric, agitating said solvent and said fabric, and removing said fabric from said solvent.

6. The method of claim 5 wherein said odorant is taken from the class consisting of sodium salicylate and methyl salicylate.

7. The method of claim 6 wherein said additive comprises methyl salicylate.

* * * * *